US008506116B2

(12) United States Patent
Sloan et al.

(10) Patent No.: US 8,506,116 B2
(45) Date of Patent: Aug. 13, 2013

(54) SHELF LIGHTING DEVICE AND METHOD

(75) Inventors: Thomas C. Sloan, Santa Barbara, CA (US); Bruce Quaal, Ventura, CA (US)

(73) Assignee: The Sloan Company, Inc., Ventura, CA (US)

( * ) Notice: Subject to any disclaimer, the term of this patent is extended or adjusted under 35 U.S.C. 154(b) by 741 days.

(21) Appl. No.: 12/616,620

(22) Filed: Nov. 11, 2009

(65) Prior Publication Data

US 2011/0084627 A1 Apr. 14, 2011

Related U.S. Application Data

(60) Provisional application No. 61/251,216, filed on Oct. 13, 2009.

(51) Int. Cl.
*F21V 1/00* (2006.01)

(52) U.S. Cl.
USPC ..... 362/235; 362/341; 362/346; 362/249.02; 362/343

(58) Field of Classification Search
USPC ..... 362/235, 240, 341, 326, 343, 249.02
See application file for complete search history.

(56) References Cited

U.S. PATENT DOCUMENTS

| | | | | |
|---|---|---|---|---|
| 6,016,038 | A | 1/2000 | Mueller | 315/291 |
| 6,150,774 | A | 11/2000 | Mueller | 315/291 |
| 6,969,179 | B2 | 11/2005 | Sloan | 362/219 |
| 7,192,157 | B2 | 3/2007 | Sloan | 362/216 |
| 7,213,941 | B2 | 5/2007 | Sloan | 362/246 |
| 7,234,838 | B2 | 6/2007 | Sloan | 362/249 |
| 7,241,031 | B2 | 7/2007 | Sloan | 362/373 |
| 7,448,768 | B2 | 11/2008 | Sloan | 362/145 |
| 2007/0195535 | A1 * | 8/2007 | Artwohl et al. | 362/341 |

FOREIGN PATENT DOCUMENTS

| | | | |
|---|---|---|---|
| EP | 2 055 211 | A1 | 5/2009 |
| EP | 2 071 227 | A1 | 6/2009 |
| WO | WO 03/102467 | A2 | 12/2003 |
| WO | WO 2006/067777 | A2 | 6/2006 |
| WO | WO 2007/053026 | A1 | 5/2007 |

OTHER PUBLICATIONS

International Search Report and Written Opinion for PCT/US2010/002699 mailed Jul. 20, 2011.

* cited by examiner

*Primary Examiner* — Ali Alavi
(74) *Attorney, Agent, or Firm* — Koppel, Patrick, Heybl & Philpott

(57) ABSTRACT

The present invention provides various embodiments for apparatuses, systems, and methods for lighting devices used in shelving, displays, and the like. Some embodiments provide lighting device comprising elongated extrusions with a first surface and a second surface proximate the first surface. The second surface may be reflective. One or more light emitting devices may be mounted at the first surface of the extrusion. The first surface is angled with respect to the second surface such that at least a portion of the light emitted from the light emitting devices reaches the second surface. If the second surface is reflective, at least a portion of the emitted light will be reflected from the second surface. A protective and possibly light diffusive lens may be provided between the first and second surfaces. In other embodiments, lighting systems may be provided with a plurality of lighting devices as described above. One or more power transfer devices may be provided to connect the lighting devices in vertical and/or horizontal arrangements, and at least one power supply may be provided to power the power transfer devices and lighting devices. Additionally, dimmer devices with integrated sensors may be included to dim the lighting devices when reduced illumination is desired.

25 Claims, 9 Drawing Sheets

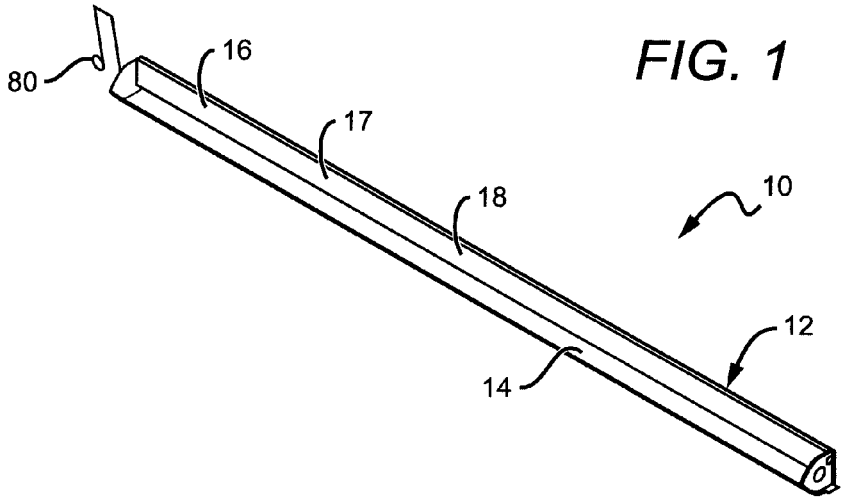
FIG. 1
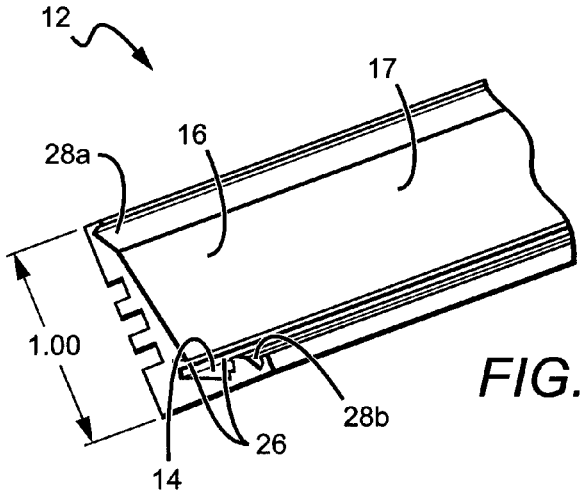
FIG. 3
FIG. 2
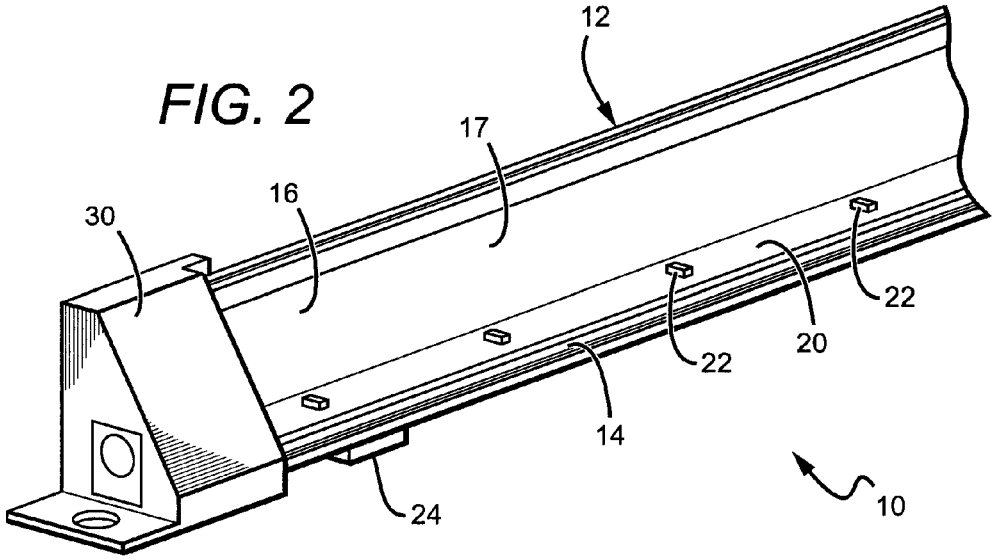

FIG. 4
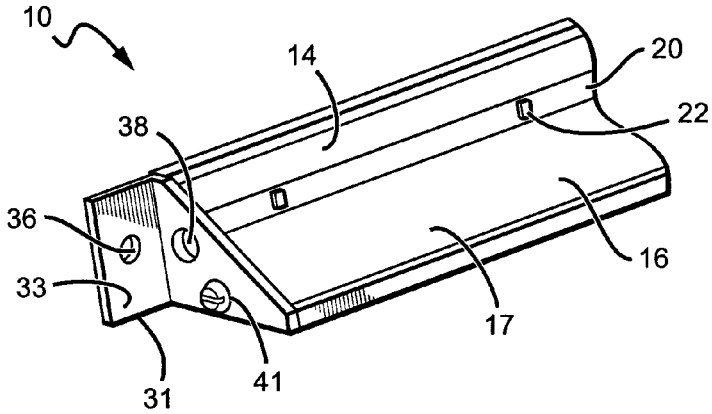
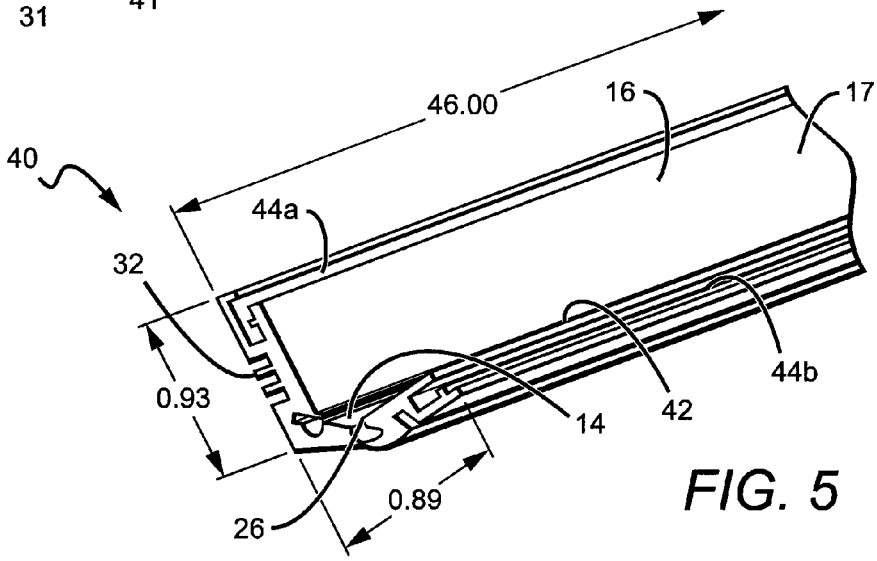
FIG. 5
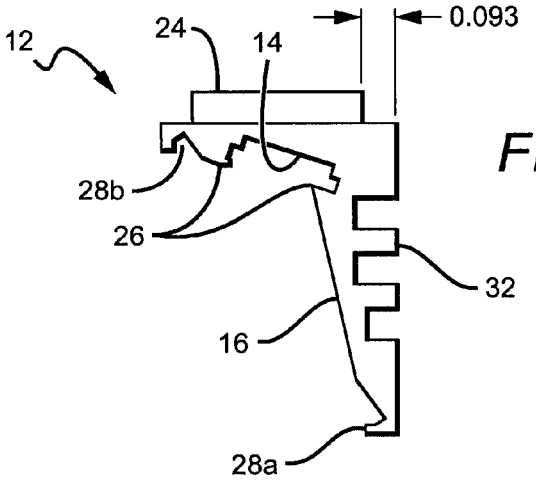
FIG. 6

FIG. 7
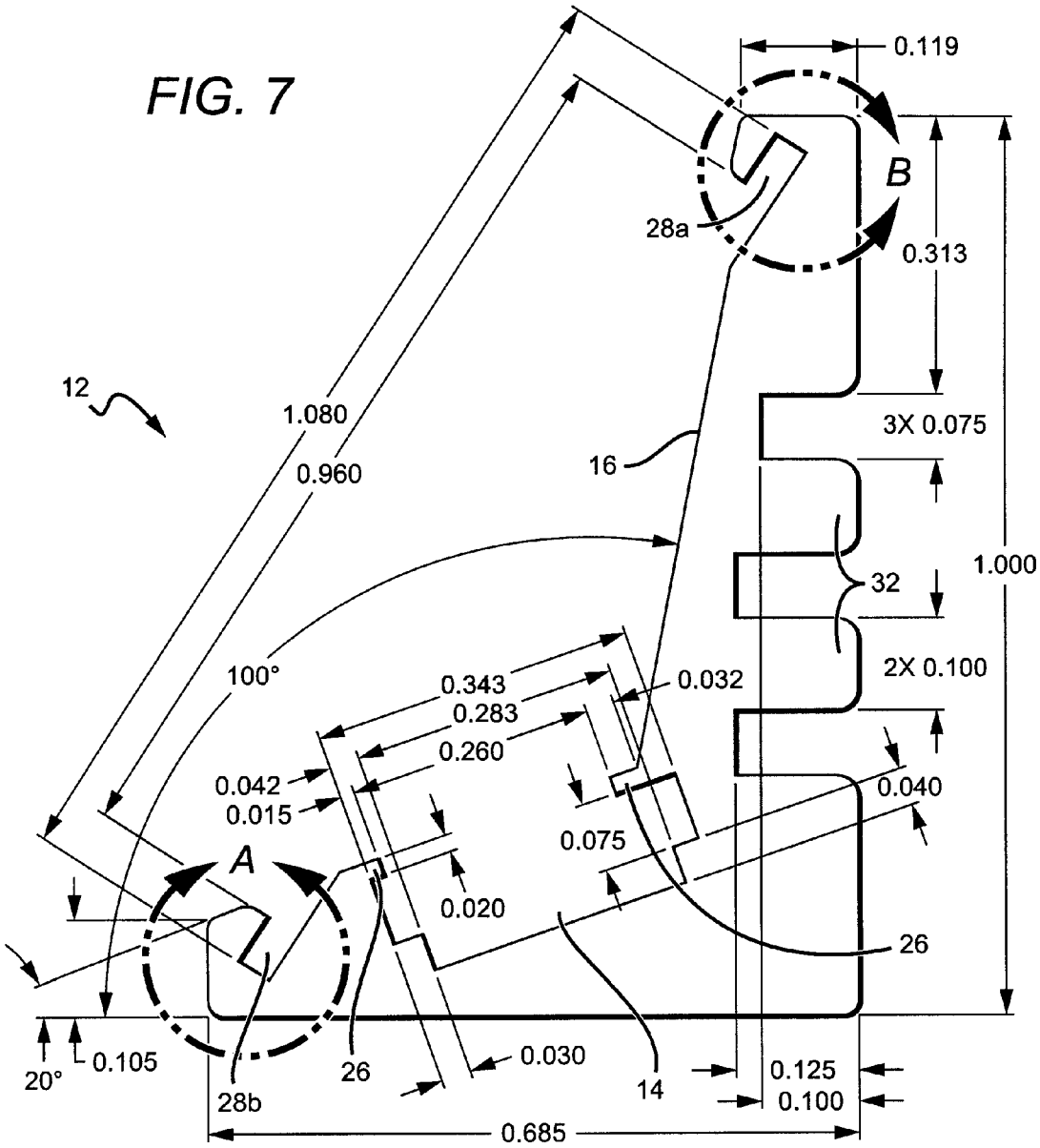
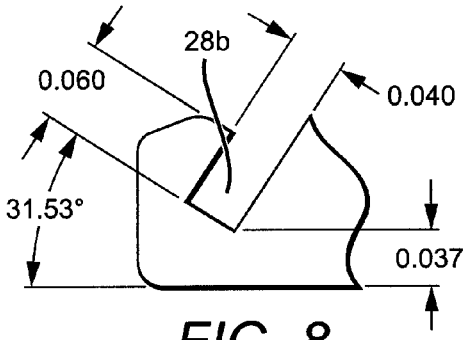
FIG. 8
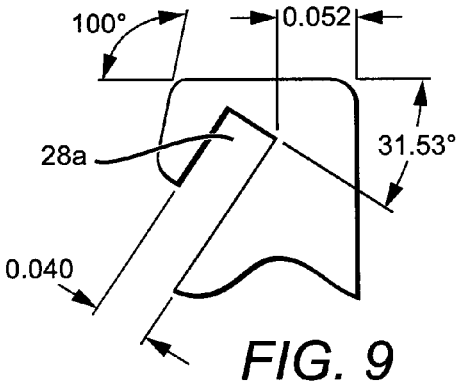
FIG. 9

FIG. 10
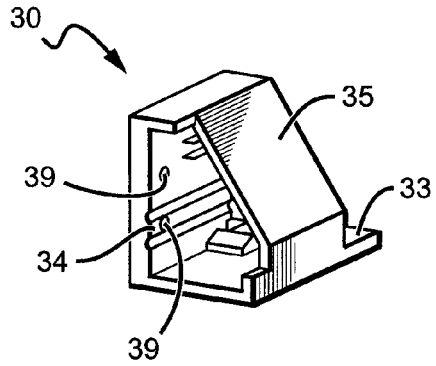
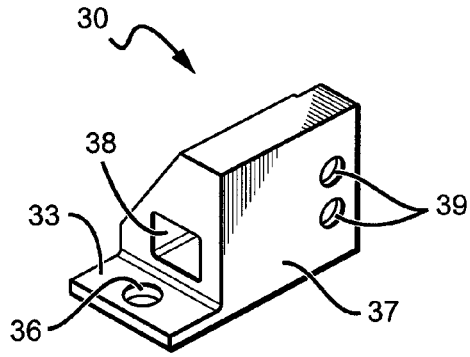
FIG. 11
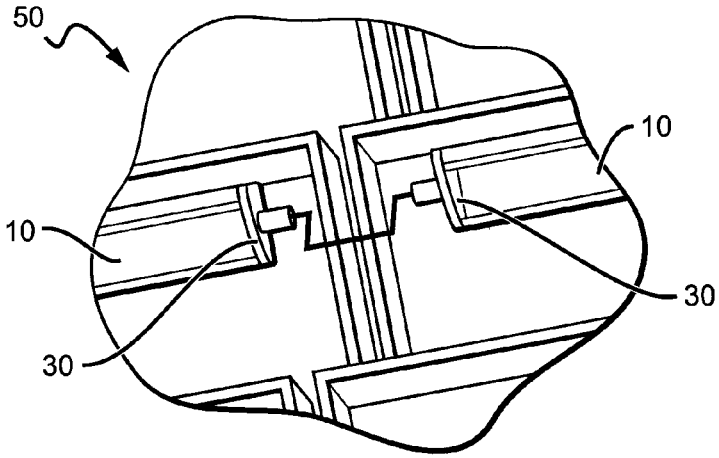
FIG. 12a
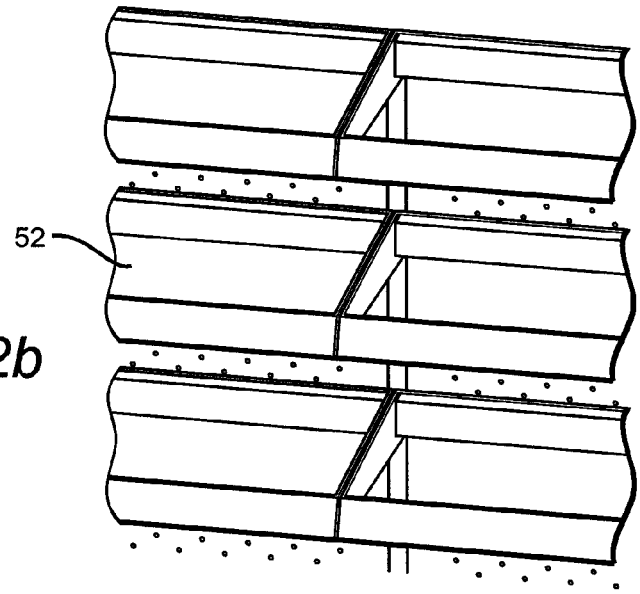
FIG. 12b

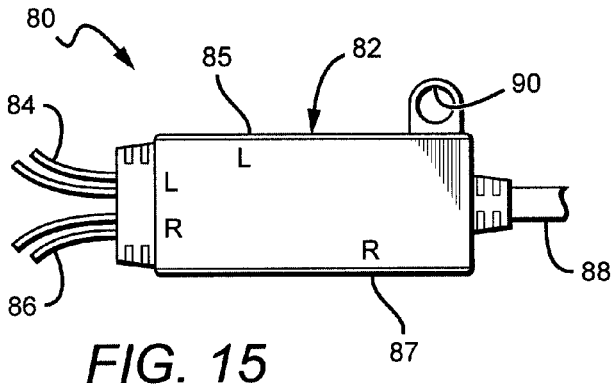
FIG. 15
FIG. 16
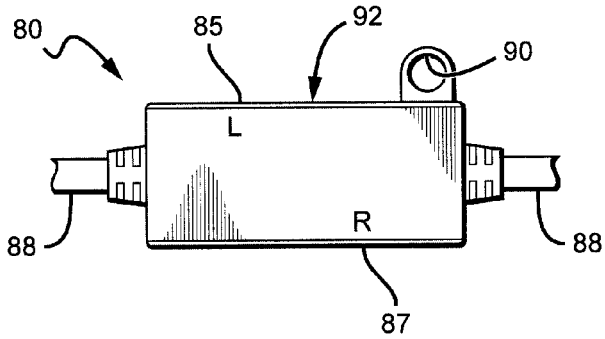
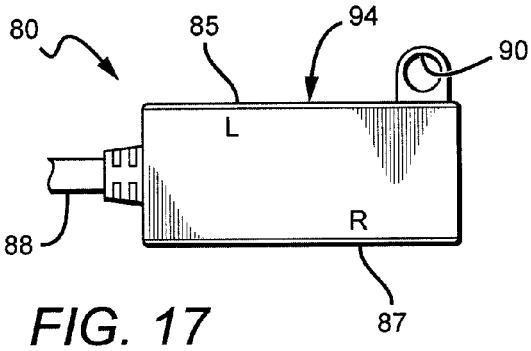
FIG. 17
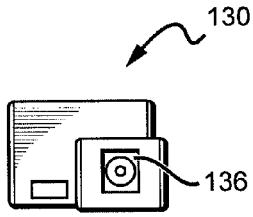
FIG. 24

FIG. 18
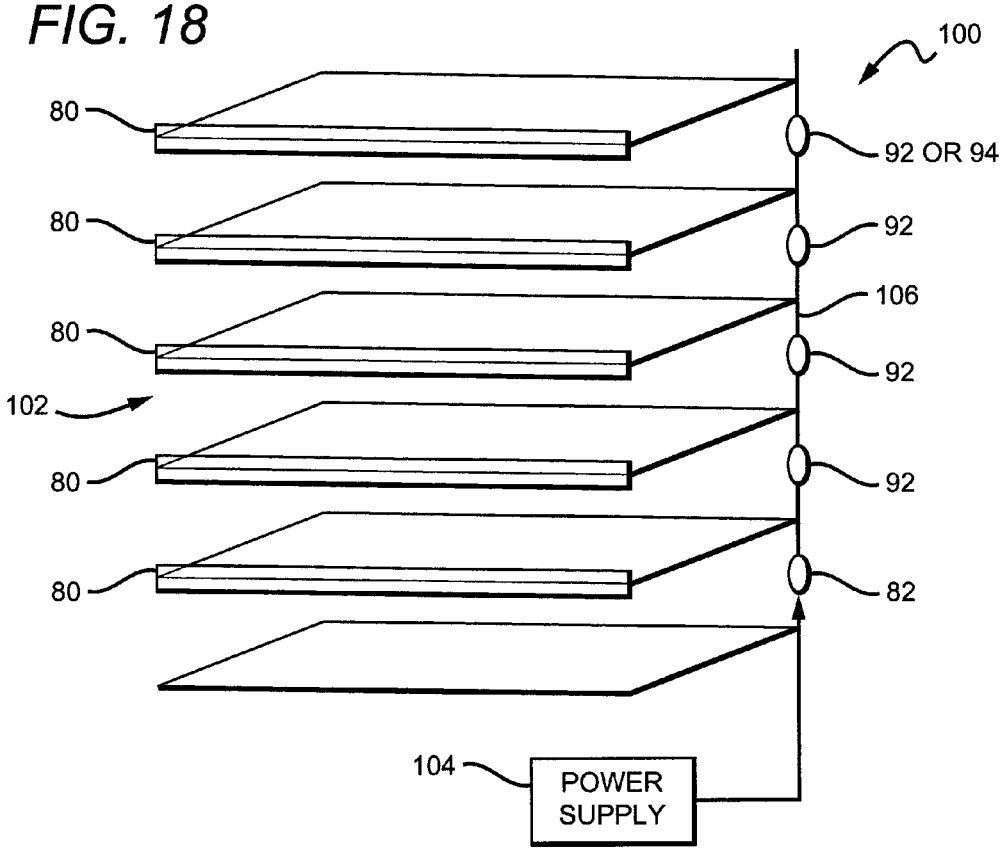
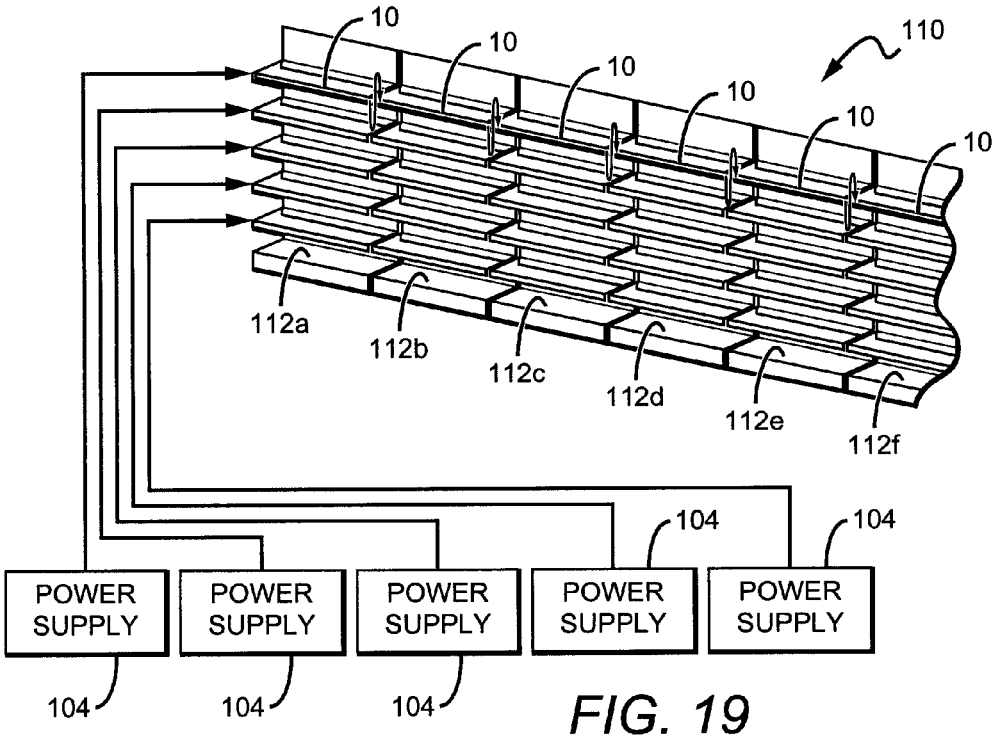
FIG. 19

FIG. 20
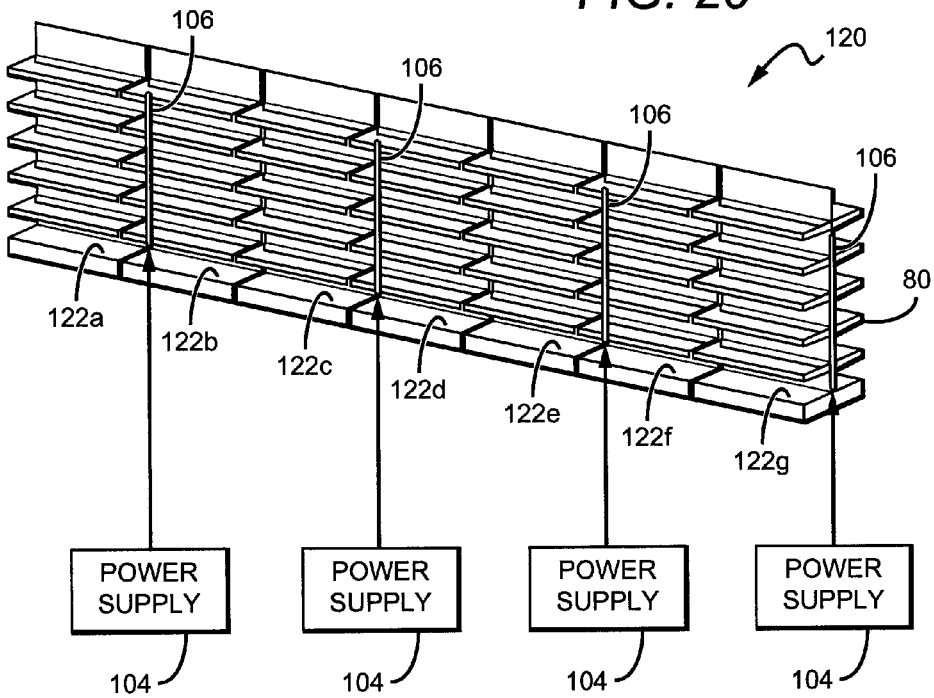
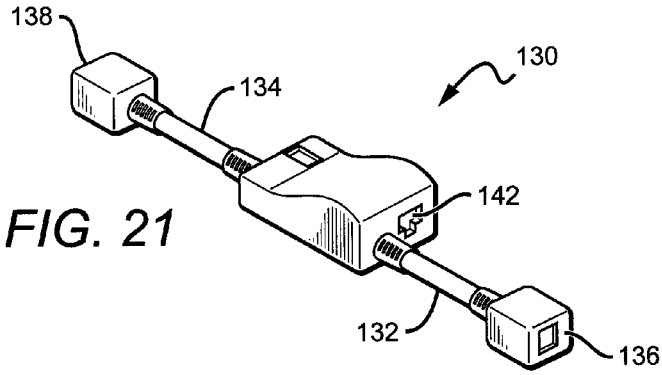
FIG. 21
FIG. 22
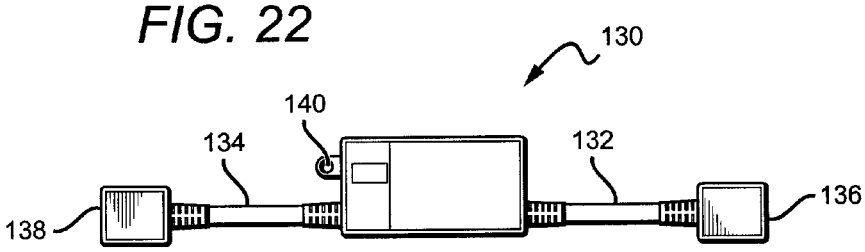

SHELF LIGHTING DEVICE AND METHOD

This application claims the benefit of provisional application Ser. No. 61/251,216 to Thomas Sloan, et al., which was filed on 13 Oct. 2009.

BACKGROUND OF THE INVENTION

1. Field of the Invention

The present invention generally relates to lighting devices, and more particularly to lighting devices for illuminating shelves, displays, and the like.

2. Background

Over the years, improvements in the number and types of lighting devices used for illuminating shelves, displays, and spaces for retail/commercial and/or private applications have been made. Retail/commercial applications may include shelving and displays in various locations, such as supermarkets, drug stores, department stores, warehouse stores, and so forth. Such lighting devices are commonly used to illuminate retail products for easier observation by consumers. They can also be used to create desired lighting effects for retail products, commercial spaces, and the like.

These lighting devices are commonly mounted in shelves or displays so they are able to illuminate retail products or spaces, and it is preferable for them to not be seen or readily noticeable. To effectuate such illumination without the device itself being readily visible, the lighting devices may be substantially low profile such that their length is significantly longer than their height. Such lighting devices may thus be housed in low profile extrusions.

Light emitting diodes (LEDs) mounted on circuit boards may be used within these lighting devices, although other types of light emitting devices may also be used. LEDs are solid state devices that convert electric energy to light, and generally comprise one or more active layers of semiconductor material sandwiched between oppositely doped layers. When a bias is applied across the doped layers, holes and electrons are injected into the active layer where they recombine to generate light. Light is emitted from the active layer and from all surfaces of the LED.

Developments in LED technology have resulted in devices that give off less heat and are brighter, more efficient and more reliable. LEDs are now being used in many applications that were previously the realm of incandescent fluorescent or neon bulbs; some of these include displays, shelf lighting, commercial lighting, and any other application where lighting is desirable or may be required.

It is desirable to have a lighting apparatus mountable in shelving, displays, commercial spaces, and the like for illuminating consumer products and/or providing desired illumination effects while increasing light optimization and decreasing the heat given off and the overall energy required to power the device. Moreover, it is desirable to provide a lighting apparatus that is durable, relatively low profile, and can be customized to fit and be mounted on a variety of different structures. Additionally, it is desirable to provide a lighting apparatus that may be daisy-chained to one or more additional lighting apparatuses and power transfer devices to provide sufficient power for illuminating multiple shelves/displays; the connected lighting devices may be arranged in horizontal and/or vertical layouts.

SUMMARY OF THE INVENTION

The present invention provides apparatuses, systems, and methods for lighting devices for use in shelving, displays, and the like with increased light optimization, durability, and customization and decreased energy footprints. One embodiment provides a lighting device comprising an elongated extrusion with a first surface and a second surface proximate the first surface, wherein the second surface is substantially reflective. It further comprises one or more light emitting devices mounted at the first surface of the extrusion. The first surface is angled with respect to the second surface such that at least a portion of the light emitted from the one or more light emitting devices reflects off the second surface.

Another embodiment provides a lighting device comprising an elongated extrusion with a first surface and a second surface proximate the first surface. One or more light emitting devices are also provided, with the light emitting devices mounted at the first surface of the extrusion. A lens between the first and second surface is also provided, with the lens protecting the one or more light emitting devices. The first surface is angled with respect to the second surface such that at least a portion of the light emitted from the one or more light emitting devices reaches the second surface.

Another embodiment provides a lighting system with a plurality of lighting devices, with each lighting device comprising: an elongated extrusion with a first surface and second surface proximate the first surface, and one or more light emitting devices mounted at the first surface of the extrusion. The first surface is angled with respect to the second surface such that at least a portion of the light emitted from the one or more light emitting devices reaches the second surface. The system further provides one or more power transfer devices electrically connecting the lighting devices, and at least one power supply device providing electrical power to the power transfer devices and lighting devices.

Another embodiment provides a method for providing lighting for shelving or a display. The method comprises providing: two or more lighting devices, and one or more power transfer devices. The two or more lighting devices are electrically connected with at least one of the power transfer devices, with the lighting devices connected in one or both of a horizontal or vertical arrangement. Furthermore, at least one power supply device is provided for electrically powering each of the power transfer devices and lighting devices.

These and other further features and advantages of the invention would be apparent to those skilled in the art from the following detailed description, taken together with the accompanying drawings, in which:

BRIEF DESCRIPTION OF THE DRAWINGS

FIG. 1 is a perspective view of one embodiment of a lighting device according to the present invention;

FIG. 2 is a partial perspective view of one embodiment of a lighting device with end cap according to the present invention;

FIG. 3 is a partial perspective view of one embodiment of an extrusion according to the present invention;

FIG. 4 is a partial perspective view of one embodiment of a lighting device with end cap according to the present invention;

FIG. 5 is a partial perspective view of one embodiment of an extrusion according to the present invention;

FIG. 6 is a side view of the extrusion shown in FIG. 3;

FIG. 7 is a side dimensional view of the extrusion shown in FIG. 3;

FIG. 8 is a detail dimensional view of section A shown in FIG. 7;

FIG. 9 is a detail dimensional view of section B shown in FIG. 7;

FIG. 10 is a perspective view of one side of an end cap according to one embodiment of the present invention;

FIG. 11 is a perspective view of the opposite side of the end cap shown in FIG. 10;

FIG. 12*a* is a perspective view of a plurality of connected lighting devices underneath shelving used in accordance with the present invention;

FIG. 12*b* is a perspective view looking down on the shelving of FIG. 12*a*, with the plurality of lighting devices hidden from view;

FIG. 15 is a top perspective view of a power transfer device according to the present invention;

FIG. 16 is a top perspective view of another power transfer device according to the present invention;

FIG. 17 is a top perspective view of another power transfer device according to the present invention;

FIG. 18 is a perspective view of a plurality of vertically connected power transfer devices on a gondola used in accordance with the present invention;

FIG. 19 is a perspective view of a plurality of horizontally connected power transfer devices and lighting apparatuses on a plurality of gondolas used in accordance with the present invention;

FIG. 20 is a perspective view of a plurality of vertically connected power transfer devices and lighting devices on a plurality of gondolas used in accordance with the present invention;

FIG. 21 is a perspective view of one embodiment of a dimmer device according to the present invention;

FIG. 22 is a top perspective view of the dimmer device shown in FIG. 21;

FIG. 24 is an end perspective view of the dimmer device shown in FIG. 21.

DETAILED DESCRIPTION OF THE INVENTION

Figure 13A:
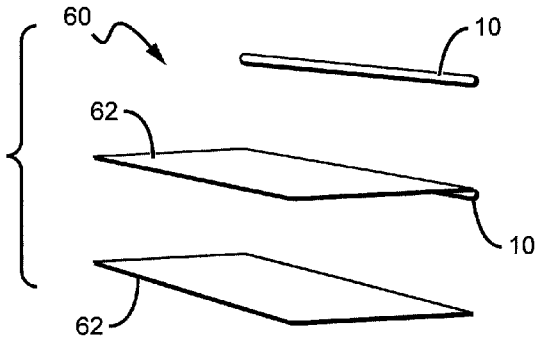
FIG. 13*a* is a diagram of lighting devices mounted in shelves according to the present invention.

The following description presents several possible embodiments. This description is not to be taken in a limiting sense but is made merely for the purpose of describing the general principles of the invention, the scope of which is further understood by the appended claims.

The present invention provides apparatuses, systems, and methods for lighting devices, in particular lighting devices used to illuminate shelves, displays, and spaces in retail/commercial and/or private spaces. Some embodiments are particularly applicable in illumination applications for shelf lighting, refrigeration lighting, displays, magazine racks, and any other location where linear lighting may be required. The optoelectronic elements may include one or more circuit boards with light emitting diodes (LEDs), solar cells, photodiodes, laser diodes, and other such optoelectronic elements or combinations of optoelectronic elements. Preferred embodiments of the present invention are generally directed to lighting devices incorporating LEDs, but it is understood that the other light emitting devices discussed may also be used. Some embodiments of the lighting devices are designed, at least in part, to emit light in focused, customized emission paths to most effectively illuminate displays, products, spaces or the like while also reducing the power needed to operate the devices.

The lighting devices comprise an extrusion which is easy to manufacture, low in cost, easy to use and mount, and houses the light emitting device(s) in a precise and aesthetically pleasing manner. The lighting device is also preferably substantially low profile such that the height of its body is short in comparison to the length of its body. Furthermore, the lighting devices are customizable to a variety of different lengths and shapes, and particularly adapted to applications where linear lighting is desired or required in vertical and/or horizontal configurations. It is understood, however, that the lighting devices can be used for many different applications. Exemplary methods for manufacturing the main body of such lighting devices may include, for example, forming extrusions using processes well known in the art. However, it is understood that many other manufacturing methods may be used.

The lighting devices can further comprise at least one end cap to protect the housed components and allow passage of a cable into the housing. The end caps may also allow for rotation of the lighting devices such the angles of the emitted light can be changed as desired. The lighting devices may each generally consist of a hollow center with an inner surface for holding light emitting devices. The inner surface may be particularly adapted for holding printed circuit boards with LEDs, but it understood that many other electronic devices and/or optoelectronic devices may be incorporated in the housing.

The present invention is described herein with reference to certain embodiments but it is understood that the invention can be embodied in many different forms and should not be construed as limited to the embodiments set forth herein. In particular, the present invention is described below in regards to lighting devices with extrusions having angled surfaces for optimal, focused light emission, but it is understood that lighting devices according to the present invention can be used for emitting light in many different ways/directions.

It is also understood that when an element or feature is referred to as being "on" another element or feature, it can be directly on the other element or feature or intervening elements may also be present. Furthermore, relative terms such as "inner", "outer", "upper", "above", "lower", "beneath", and "below", and similar terms, may be used herein to describe a relationship of one element or feature to another. It is understood that these terms are intended to encompass different orientations of the housing and its components and contents in addition to the orientation depicted in the figures.

Although the terms first, second, etc. may be used herein to describe various elements, components, features and/or sections, they should not be limited by these terms. These terms are only used to distinguish one element, component, feature or section from another. Thus, a first element, component, feature or section discussed below could be termed a second element, component, feature or section without departing from the teachings of the present invention.

Embodiments of the invention are described herein with reference to illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the regions illustrated herein but are to include deviations in shapes that result, for example, from manufacturing. A feature illustrated or described as square or rectangular can have rounded or curved features due to normal manufacturing tolerances. Thus, the features illustrated in the figures are not intended to illustrate the precise shape of a feature and are not intended to limit the scope of the invention.

FIGS. 1 and 2 show perspective views of one embodiment of a lighting device 10 according to the present invention. The lighting device 10 comprises an elongated extrusion 12, with the extrusion 12 comprising a device-supporting first surface 14, a second surface 16, an optional third surface 18 between the first surface 14 and second surface 16, an elongated printed circuit board 20, multiple LEDs 22, magnet(s) 24, and end cap(s) 30.

As can be seen in FIGS. 1 and 2, the lighting device 10 in some embodiments is generally an elongated, low profile shape, with a generally triangular cross-section. The extrusion 12 spans almost the entire length of the lighting device 10, and may comprise two or three sides along its length. In the embodiment shown in FIGS. 1-3, the extrusion 12 comprises two sides—first surface 14 and second surface 16. However, it is understood that an extrusion may be manufactured having three sides such that a third side would be co-extruded, forming a hollow, three-sided extrusion. In the embodiment shown in FIG. 1, a third surface 18 may be added to the extrusion 12, spanning between first surface 14 and second surface 16. The third surface 18 may act as a cover to protect the underlying electronics, and/or may comprise a lens to assist with desired light emission.

The first surface 14 is designed to accept circuit board 20 and LEDs 22. The circuit board 20 and LEDs 22 may be placed on and secured to first surface 14 using adhesives, soldering, posts, screws, or other common bonding means as well known in the art. Alternatively, circuit board 20 with incorporated LEDs 22 may be slid into a groove of first surface 14 sized to securely accept circuit board 20 (see FIG. 3). First surface 14 is proximate second surface 16, with first surface 14 being at an angle with respect to second surface 16 such that at least a portion of the light emitted from the light emitting devices on first surface 14 are directed toward second surface 16. The light may reflect off second surface 16, and the angles of first and second surface 14, 16 may be customized to achieve desired directed light from the lighting device 10.

The extrusion 12 is preferably made from aluminum, although it is understood that other metals or materials such as acrylic or plastic may also be used. The extrusion 12 preferably contains facets to reflect light from the light emitting devices in order to optimize the lighting profile. Accordingly, extrusion 12 may comprise an integrated reflector 17, which is preferably incorporated with second surface 16, but it is understood that portions of first surface 14 may also comprise reflective characteristics. The integrated reflective surface may be achieved by polishing the aluminum of the extrusion; this can be accomplished by anodizing the surface and polishing a mirror-like finish as is well known in the art. Alternatively, the reflective surface may be achieved by providing reflective tape or a reflective insert such as a plastic insert.

The reflector 17 is incorporated for focusing light from the light emitting devices and creating desired illumination patterns. The angle of reflector 17 may be customized to optimize light emission for a variety of different light emitting device viewing angles. The reflector may be used to direct light emission such that products/items in displays and/or shelving may be optimally illuminated. For example, the light may be directed such that it creates light peaks to best highlight products on display in shelves.

The third surface 18, which may be a lens and/or protective cover, is preferably made from a substantially clear material with light diffusive and directive properties such as acrylic or glass, although it is understood that other materials and colors may be used as well. Light diffusants such as scattering particles (e.g. Titanium oxides) or calcium carbonate may be added to the third surface 18 material during the fabrication process. To further maximize the diffusive properties of third surface 18, the surface finish should be as smooth as possible. Possible diffusive properties of the third surface 18 allow the light sources on the circuit board to appear as one, continuous light source when they emit light. Furthermore, the third surface 18 may form a variety of different shapes to change the convergence of emitted light paths such that the light emitted from the lighting device 10 may be further directed as desired.

Circuit board 20 preferably comprises a plurality of LEDs 22 along its length. However, it is understood that other suitable light emitting devices may also be used in accordance with the present invention. LEDs are desirable because they require less energy to operate more efficiently than traditional lighting in linear applications. LEDs 22 may be incorporated to emit any color or combination of colors according to desired emission effects; the colors may also be adapted to change frequently if desired. For example, in applications where the lighting device(s) will be used to illuminate products, white light is likely preferable to best show off the features of the products. In application where the lighting device(s) will be used to illuminate spaces, any color or combination of colors can be used as desired.

Magnet(s) 24 may be provided on the back side of first surface 14 to attach the lighting device 10 to a metal surface such as a shelf. However, it is understood that other attachment means may be provided, such as screws, double-sided adhesive tape, track system, surface bonding, simple placement on a supporting surface, or the like.

As a result of the low profile shape of lighting device 10, the external ends preferably comprise a surface area that is minimized when compared to the surface area along the length of the lighting device 10. This allows the ends to be capped more easily and efficiently than a lighting device with a comparatively larger surface area on its capping/sealing portion. Moreover, the low profile design of the lighting device allows for it to be more easily mounted out of view.

FIGS. 3 and 6 depict one embodiment of the extrusion 12 shown in FIG. 2. In addition to what has been described above, extrusion 12 further comprises first flanges 26, grooves 28*a*, 28*b*, and second flanges 32. First flanges 26 project toward one another in a direction substantially parallel to that of first surface 14. The first flanges 26 are provided for applications when a printed circuit board 20 with LEDs 22 is to be slid into place in the recess in first surface 14, which is partially covered by first flanges 26. The recess in first surface 14 and the first flanges 26 are preferably sized to create a space that is slightly larger than that of a printed circuit board 20. As such, the printed circuit board 20 may be easily slid into place, while still being secured by the confines of the recess and first flanges 26. In addition to the recess and first flanges 26, adhesives or other bonding means may be used to further secure the circuit board 20 in place. The first flanges 26 also preferably comprise a space between them such that LEDs 22 are exposed and able to easily emit light from first surface 14.

Grooves 28*a*, 28*b* may be provided to accept the edges along the length of third surface 18. It is understood that such grooves are not needed when a third surface 18 is co-extruded with first and second surface 14,16. When third surface 18, such as a lens and/or protective cover, is later installed onto extrusion 12, grooves 28*a*, 28*b* are sized to fit accept the edges of third surface 18 such that it may be easily slid into place while also securely holding third surface 18 in place. In addition to the secure fit realized by grooves 28*a*, 28*b*, adhesives or other bonding means may be used to further secure third surface 18 into place.

Second flanges 32 may be provided to coincide with indentations in an end cap (see, e.g., FIG. 10 and the accompanying description). The second flanges 32 will be sized to fit in indentations created by flanges on an end cap for creating a secure fit. In addition, the second flanges 32 may be provided to create indentations between them that may accept screws, posts, or other similar mounting means for securing an end cap to the end of an extrusion.

FIG. 4 depicts the extrusion shown in FIGS. 1 and 2, but with the addition of an end cap 31. The end cap 31 is provided to cap at least one end of an extrusion, and may further be designed to seal at least one end of an extrusion in order to protect the housed light emitting devices and other electronics against environmental conditions such as moisture. The end cap is preferably formed of a material that is resistant to water and other environment conditions that could otherwise infiltrate the housing. Suitable materials include metals and plastics, but it is understood that other relevant materials may be used. Moreover, end caps may be constructed, at least in part, of a substantially flexible material such as silicone that can withstand thermal emissions from the housed electronics and variations in the extrusion that result from the manufacturing process.

End cap 31 may include internal flanges and indentations (not shown) to correspond and fit with second flanges 32 and indentations in extrusion 12; as such, the end cap may be sized to slide over the end of extrusion 12, with the various flanges and indentations providing a secure fit. End cap 31 is preferably sized to be slightly larger than the external portion of at least one end of extrusion 12 to compensate for any changes in the extrusion 12 caused by manufacturing variations and or thermal expansion. While end cap 31 is depicted as having a generally triangular cross-section to conform with a generally triangular end of extrusion 12, it is understood that the end cap 31 may be configured in any number of relevant shapes, such as a square, rectangle, or oval.

When the end cap 31 is placed on at least one end of the extrusion 12, an adhesive, in addition to the flanges and indentations of cap 31 and extrusion 12, may be used to further secure the end cap 31 to the extrusion 12. While any number of adhesives known in the art can be used, it may be preferable to use an adhesive that is thermally resistive and can seal the interior of the extrusion from environmental conditions such as moisture.

End cap 31 further comprises an extension 33 with a hole 36, a cable hole or power socket 38 and an angle adjustment portion 41. The extension 33 provides an additional surface extending away from the main body of end cap 31, which is used to secure the end cap to an external surface. However, it is understood that there are any number of various extensions, protrusions and the like that may be alternatively used to secure the end cap to an external surface. A screw, nail, post or the like may be passed through hole 36 to connect end cap 31 to an external surface.

Cable hole or power socket 38 is provided in end cap 31 such that a cable (not shown) may be passed through to provide power to the housed light emitting devices; alternatively, power socket 38 is provided to accept a plug from a power supply (not shown). The diameter of hole or socket 38 may be slightly larger than the diameter of the cable or plug such that the cable or plug may be easily fitted through hole 38. Alternative, if an end cap is made of a substantially flexible material such as silicone, the diameter of the hole 38 may be sized slightly smaller than the diameter of a cable such that a seal is created around the cable to prevent environmental conditions from infiltrating the interior of the lighting device 10.

Angle adjustment portion 41 may be provided in end cap 31 to allow for the angle of the extrusion 12 and integrated reflector 17 to be altered to direct the light emitted from lighting device 10 in a preferred manner. The angle adjustment portion 41 can comprise a number of different mechanisms to allow for such angular adjustment, with one simple mechanism comprising a screw or the like that may be loosened such that the extrusion can be tilted; once the extrusion and its integrated reflector 17 are in a desired position for optimized light emission, the screw can be retightened to hold the extrusion in place. The screw of angle adjustment portion 41 may correspond to one or more of the indentations between second flanges 32 of the extrusion, with those indentations moveable with respect to the angle adjustment portion 41. While the above-described mechanism provides one possible embodiment for angular adjustment of the reflector 17, it is understood that additional mechanisms would be contemplated in practicing the present invention. For example, the integrated reflector 17 may comprise a portion that is separate from extrusion 12, such that extrusion 12 itself is not moveable by angle adjustment portion 41, but the angle of reflector 17 alone is moveable by angle adjustment portion 41.

FIG. 5 depicts another embodiment of an extrusion 40 according to the present invention. In addition to the first and second surfaces 14,16, reflector 17, first flanges 26, and second flanges 32 described above, extrusion 40 comprises an overhang portion 42 that may comprise an additional reflective surface for further directing the light emitted from lighting device 10. The overhand portion 42 may be co-extruded with first and second surface 14, 16, or may comprise a separate piece that is later attached to extrusion 40. If overhang portion 42 is attached at a later stage, it may be movably attached such that its angle is easily adjusted.

The overhang portion 42 is proximate first surface 14, and provides a further surface for light emitted from light emitting devices at said first surface 14 to reflect off of. In this way, at least some of the light emitted from light emitting devices can emit toward either or both of second surface 16 and overhang portion 42. If either or both second surface 16 and overhang portion 42 comprise reflective surfaces (such as reflector 17 on second surface 16), then light can be reflected off of surface 16 and/or portion 42. Depending on the angles of surface 16 and portion 42, light emitted from first surface 14 can be reflected off surface 16 and portion 42 in any number of reflective paths. In this way, the characteristics of the light emitting from lighting device 10 are customizable and can be directed in any direction for any desired application. The overhang portion 42 may further be added to diminish any haloing effects that may otherwise exist in extrusions without such an overhang portion. Haloing effects may or may not be desirable depending on the intended application and desired effects of a lighting device according to the present invention.

Extrusion 40 further comprises grooves 44*a*, 44*b*, which are similar to grooves 28*a*, 28*b* described above. The main difference is groove 44*b* is integral to overhang portion 42, where groove 28*b* was integral to first surface 14. As with grooves 28*a*, 28*b*, grooves 44*a*, 44*b* may be provided to accept the edges along the length of third surface 18. It is understood that such grooves are not needed when a third surface 18 is co-extruded with first surface 14, second surface 16, and overhang portion 42. When third surface 18, such as a lens and/or protective cover, is later installed onto extrusion 12, grooves 44*a*, 44*b* are sized to accept the edges of third surface 18 such that it may be easily slid into place while also securely holding third surface 18 in place. In addition to the secure fit realized by grooves 44*a*, 44*b*, adhesives or other bonding means may be used to further secure third surface 18 into place.

FIG. 5 also shows some possible dimensions for extrusion 40, although it is understood that these dimensions are examples and not intended to narrow the scope of the invention. The dimensions of low profile extrusion 40 can depend on the one or more anticipated electronic and/or optoelectronic devices to be housed within, the expected implementation of the extrusion 40 and its components, the amount of light to be discharged by the device, and/or other such factors. For example, according to one embodiment, the approximate dimensions of the extrusion 40 can include a height from the bottom of first surface 14 to the top of second surface 16 of 0.93 inches, and a width from the end of first surface 14 proximate said second surface 16 to the edge of overhang portion of 0.89 inches. The overall length of the extrusion 40 may be 46.00 inches. With these measurements, it is apparent that the extrusion 40 is substantially low profile.

FIGS. 7-9 depict dimensional views of the extrusion 12 best shown in FIGS. 3 and 6. It is understood that these dimensions are examples and not intended to narrow the scope of the invention. The dimensions of extrusion 12 can depend on the one or more anticipated electronic and/or optoelectronic devices to be housed within, the expected implementation of the extrusion 12 and its components, the amount of light to be emitted by the device, and/or other such factors. For example, according to one embodiment, the dimensions of the extrusion 12 are particularly adapted for use in shelves that are 18 inches deep and 12 inches apart. The angles of the various surfaces are provided for optimized light emission to showcase the contents of such shelves. However, it is understood that different dimensions and angles would be preferred for shelving/displays with different orientations and spacings. For this example, the approximate dimensions of the extrusion 12 can include: a height from the bottom of surface 14 to the top of surface 16 of 1.000 inches, a height from the top of the topmost indentation to the top of second surface 16 of 0.313 inches, heights of each of the three indentations along second surface 16 of 0.075 inches, heights of each of flanges 32 of 0.100 inches, a height from the bottom of the bottommost indentation to the bottom of second surface 16 of 0.040 inches, a width of the topmost flange of 0.100 inches and the bottommost flange of 0.125, a width at the top of surface 16 of 0.119 inches, a width of first surface 14 to the bottommost edge of second surface 16 of 0.685 inches, a distance of 1.080 inches from groove 28*a* to groove 28*b*, a width of the recess in first surface 14 of 0.343 inches, a height of the leftmost side of first surface 14 of 0.105 inches, an angle between the leftmost side of surface 16 to the bottom of surface 14 of 100 degrees, an angle of grooves 28*a*, 28*b* with respect to the far surface of respective surface 14, 16 of 31.53 degrees, and so forth. Extrusion 12 may be cut to any variety of lengths depending on the intended use.

For an extrusion 40, the dimensions may be slightly different, particularly with respect to the angles between: the overhang portion 42 and first surface 14; and second surface 16 and first surface 14. For example, according to one embodiment, the dimensions of the extrusion 40 are particularly adapted for use in shelves that are 18 inches deep and 12 inches apart. The angles of the various surfaces are provided for optimized light emission to showcase the contents of such shelves. However, it is understood that different dimensions and angles would be preferred for shelving/displays with different orientations and spacings. For this example, the angle between the surface of overhang portion 42 proximate the top of first surface 14 is approximately 102.50 degrees. The angle between the top of first surface 14 and the reflective surface of second surface 16 is approximately 120 degrees.

FIGS. 10 and 11 depict another end cap 30 according to one embodiment of the present invention. The end cap 30 is provided to cap at least one end of an extrusion, and may further be designed to seal at least one end of an extrusion in order to protect the housed light emitting devices and other electronics against environmental conditions such as moisture. The end cap is preferably formed of a material that is resistant to water and other environment conditions that could otherwise infiltrate the housing. Suitable materials include metals and plastics, but it is understood that other relevant materials may be used. Moreover, end caps may be constructed, at least in part, of a substantially flexible material such as silicone that can withstand thermal emissions from the housed electronics and variations in the extrusion that result from the manufacturing process.

End cap 30 may include internal flanges 34 and indentations between the flanges to correspond and fit with second flanges 32 and indentations in extrusion 12; as such, the end cap may be sized to slide over the end of extrusion 12, with the various flanges and indentations providing a secure fit. Furthermore, end cap 30 may comprise front angled portion 35 and rear portion 37 that, together with a bottom portion are fitted together to slide onto and extend slightly over at least one end of extrusion 12. End cap 30 is preferably sized to be slightly larger than the external portion of at least one end of extrusion 12 to compensate for any changes in the extrusion 12 caused by manufacturing variations and or thermal expansion. Rear portion 37 may additionally comprise holes 39, through which screws, posts, nails, or the like may be passed to further secure the end cap 30 to the end of extrusion 12. While end cap 30 is depicted as having a generally triangular cross-section to conform with a generally triangular end of extrusion 12, it is understood that the end cap 30 may be configured in any number of relevant shapes, such as a square, rectangle, or oval.

When the end cap 30 is placed on at least one end of the extrusion 12, an adhesive, in addition to the flanges and indentations of cap 30 and extrusion 12, may be used to further secure the end cap 30 to the extrusion 12. While any number of adhesives known in the art can be used, it may be preferable to use an adhesive that is thermally resistive and can seal the interior of the extrusion from environmental conditions such as moisture.

End cap 30 further comprises an extension 33 with a hole 36 and a cable hole or power socket 38 similar to those described above with respect to end cap 31. The extension 33 provides an additional surface extending away from the main body of end cap 30, which is used to secure the end cap to an external surface. However, it is understood that there are any number of various extensions, protrusions and the like that may be alternatively used to secure the end cap to an external surface. A screw, nail, post or the like may be passed through hole 36 to connect end cap 30 to an external surface.

Cable hole or power socket 38 is provided in end cap 30 such that a cable or plug (not shown) may be passed through to provide power to the housed light emitting devices. The diameter of hole or socket 38 may be slightly larger than the diameter of the cable or plug such that the cable or plug may be easily fitted through/into hole or socket 38. Flexible flanges or the like may be incorporated to the interior of hole or socket 38 that are angled slightly toward one another to provide traction on a cable or plug such that is more securely held in place in hole or socket 38. Alternative, if an end cap is made of a substantially flexible material such as silicone, the diameter of the hole 38 may be sized slightly smaller than the diameter of the cable such that a seal is created around the cable to prevent environmental conditions from infiltrating the interior of the lighting device 10.

While end caps 30 and 31 are designed to fit over extrusion 12, it is understood that slight modifications to their respective designs can enable them to fit over a different extrusion such as extrusion 40. For example, an end cap can be alternatively shaped to account for the overhang portion 42 of extrusion 40. Furthermore, it is understood that some end caps can be provided without a cable hole 38 for applications when no power cable is needed through one end of an extrusion, such as when a lighting device is the last in a daisy-chain of connected lighting devices.

FIGS. 12*a*, 12*b* shows a shelving display 50 wherein a plurality of lighting devices 10 are daisy-chained to one another in adjacent shelving gondolas. While there are two adjacent lighting devices 10 connected in this application, it is understood that any number of lighting devices may be connected in numerous configurations. End caps 30 (or 31) are provided on the ends of extrusions 12 to allow wire(s) and/or cables (not shown) to pass through and/or between lighting devices 10 and end caps 30 or 31. A power device (not shown) is connected to the wire/cables to provide power to the connected devices 10. In FIG. 12*a*, the connected lighting devices are installed underneath the front of the shelves, preferably hidden from view. In retail environments, they may be preferably installed behind the horizontal members holding price tags such that they are hidden from the view of the consumers. FIG. 12*b* shows the shelving display from a front perspective view, illustrating that the daisy-chained lighting devices 10 are hidden from view.

Figure 13B:
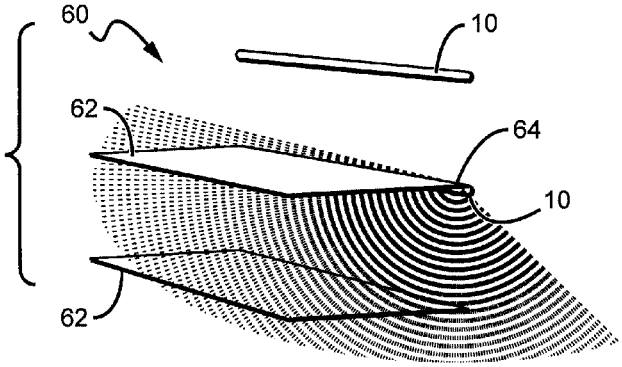
FIG. 13*b* is a diagram of light emission patterns of the mounted lighting devices of FIG. 13*a;*

FIGS. 13*a*, 13*b* show a simulation depicting the emission patterns of a lighting device according to the present invention. The lighting simulation was done for shelves 18 inches deep and 12 inches apart, but it is understood that similar simulations may be done for any length and configuration of shelves and/or displays. Furthermore, the lighting devices 10 used in the simulation were 46 inches long and each comprising thirty LEDs, with the extrusion itself being 45.5 inches long and the additional 0.5 inches in length provided by the end caps. It is understood that other lengths for lighting devices are contemplated in practicing the present invention.

In FIG. 13*a*, the lighting devices 10 are mounted to the front, bottom edge of the shelves 62 at a 20 degree mounting angle. Other mounting angles are contemplated in practicing the present invention. In FIG. 13*b*, the emission patterns of the lighting device 10 are shown, with some of the light bleeding over the top of the uppermost shelf. It is understood that the emission patterns may be focused by changing the angles of the reflector 17 and/or overhang portion 42 (if provided). As shown in FIG. 13*b*, the emitted light peaks and is the most concentrated at the top front of the shelves. The lighting devices can be mounted at different areas of the shelves or displays and/or the light can be focused differently in order to change the emission patterns of the devices.

Figure 14:
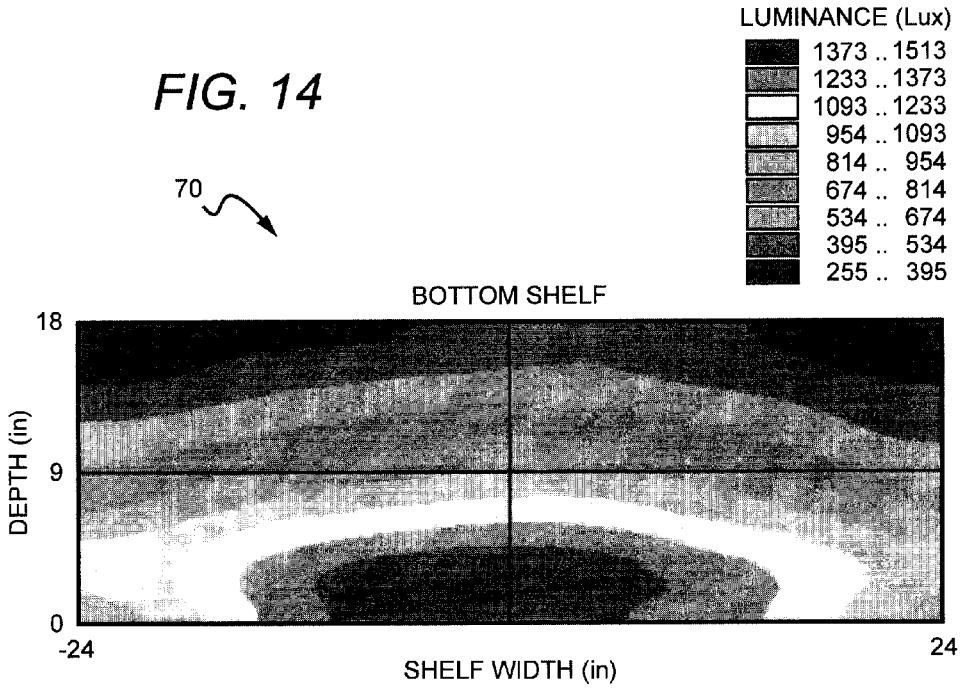
FIG. 14 is a graph of illuminance (Lux) patterns of a mounted lighting device according to the present invention.
Figure 23:
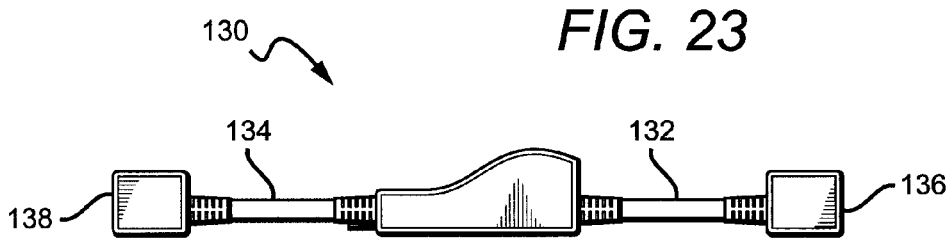
FIG. 23 is a side perspective view of the dimmer device shown in FIG. 21.

FIG. 14 shows a graph of the illuminance (Lux) at the bottom shelf of the simulation shown in FIGS. 13*a*, 13*b*. The illuminance was the greatest at the front middle of the bottom shelf, and gradually decreased toward the back and sides of the shelf. The portions of the shelf toward the back sides had the least illuminance.

FIGS. 15-17 depict power transfer devices 80 according to the present invention. The power transfer devices 80 may be provided between adjacent lighting devices 10 to daisy-chain them together and provide power to each device 10. Furthermore, the power transfer devices 80 preferably utilize low voltage, are preferably smaller and more adaptable to varying configurations than known power strips, and can also be used together as harnesses to power lighting devices in multiple shelves/displays in vertical (tree structure) configurations. In FIG. 15, a beginning module 82 of a power transfer device 80 is shown, with the beginning module 82 comprising left and right inputs. Wires 84 and 86 enter module 82 at left and right inputs from external power source(s) (not shown), and exit said module as a combined cable 88. In some arrangements, power may additionally or alternatively be supplied to or exit module 82 at left input/output 85 and/or right input/output 87 depending on how module 82 is to be used.

In FIG. 16, a center module 92 is shown, with the center module 92 accepting combined cable 88 at its leftmost side, with combined cable 88 exiting at its rightmost side. However, in some arrangements, power may additionally or alternatively be supplied to or exit module 92 at left and right inputs/outputs 85, 87 depending on how module 92 is to be used.

In FIG. 17, an end module 94 is shown, with the end module 94 accepting combined cable 88 at its leftmost side, with combined cable not exiting module 94. However, in some arrangements, power may additionally or alternatively be supplied to or exit from module 94 at left and right inputs/outputs 85, 87 depending on how module 94 is to be used.

Each of modules 82, 92, 94 may comprise a mounting portion with hole 90. A screw, nail, post, or the like may be placed through hole 90 so as to mount the power transfer devices 80 to an external surface such as a shelf, wall, or display. Alternatively, other means of mounting may be used, such as double-sided tape or other bonding means well known in the art.

FIG. 18 shows a perspective view of a vertical lighting arrangement 100 with a shelving unit, also known as a gondola, 102 having a plurality of lighting devices electrically connected in a vertical configuration using a harness 106 of five interconnected power transfer devices 80. An external power supply 104 is used to power the harness 106. Although the individual lighting devices are not visible in this view, it is understood that they are mounted in low profile to the bottom of each shelf and are hidden from view as desired. The lighting devices are mounted and secured using any of the mounting means (not shown) as described above. The devices are positioned such that light will emit out and down upon any object(s) placed on the shelves.

Power supply 104 supplies power to first module 82, which then supplies power to the first module 92 via cable 88 and a first lighting device (not shown) via left output 85. First module 92 then supplies power to second module 92 via cable 88 and a second lighting device (not shown) via left output 85 and so on until power reaches the last power transfer device 80 in the harness 106. Once power reaches module 94, module 94 will supply power to another lighting device via output 85, but will not supply power to any additional power modules in the harness 106 as it is the last in line.

While FIG. 18 depicts a gondola comprising five shelves with five lighting devices and the harness comprises five power transfer devices, it is understood that any number and/or combination of shelves, lighting devices, and power transfer devices are contemplated in practicing the present invention.

FIG. 19 depicts a plurality of connected lighting devices 10 that are connected in a horizontal configuration over six gondolas 112*a-f*. Power transfer devices are used to interconnect and provide power to each of the horizontally adjacent lighting devices 10. While there are six lighting devices 10 connected in this embodiment, it is understood that any number of lighting devices may be connected in numerous configurations as desired. Although the individual lighting devices are only illustrated on the topmost shelves in each gondola, it is understood they may be mounted on each level of shelves in each gondola. The lighting devices are mounted and secured using any of the mounting means (not shown) as described above. The devices are preferably positioned such that light will emit out and down upon any object(s) placed on the shelves.

An external power supply 104 is used to power the first lighting device on gondola 112*a*. The first lighting device then supplies power to a module 92 via leftmost cable 88, which in turn supplies power to a connected second lighting device located on gondola 112*b* via rightmost cable 88. Second lighting device then supplies power to a second module 92 via leftmost cable 88, which in turn supplies power to a connected third lighting device located on gondola 112*c* and so on until power reaches the last lighting device in the daisy-chain.

FIG. 20 shows a perspective view of a vertical lighting arrangement 120 with seven adjacent gondolas 122*a-g* having a plurality of lighting devices electrically connected in a vertical configuration using a harness 106 as described above. An external power supply 104 is used to power each harness 106. Although the individual lighting devices are not visible in this view, it is understood that they are mounted in low profile to the bottom of each shelf and are hidden from view as desired. The lighting devices are mounted and secured using any of the mounting means (not shown) as described above. The devices are positioned such that light will emit out and down upon any object(s) placed on the shelves.

The power supplies 104 supply power to the first module in each harness 106, which then supplies power to the second module via cable 88 and first and second lighting devices (not shown) via left output 85 and right output 87 respectively. Although it is not shown, it is appreciated that lighting devices are mounted on the shelves to both the left and right of each harness 106, such that each harness is providing power to two gondolas at a time. The second module then supplies power to a third module via cable 88 and a third and fourth lighting device (not shown) via left output 85 and right output 87 and so on until power reaches the last power transfer device 80 in the harness 106. Once power reaches the last module, that module will supply power to lighting devices to its left and right via outputs 85 and 87, but will not supply power to any additional power modules in the harness 106 as it is the last in line.

While FIG. 20 depicts seven gondolas 122*a-g* with each gondola comprising five shelves and five lighting devices and each harness comprising five power transfer devices, it is understood that any number and/or combination of shelves, lighting devices, and power transfer devices are contemplated in practicing the present invention.

FIGS. 20-24 show various views of a dimmer 130 used in accordance with one embodiment of the present invention. The dimmer 130 is provided to dim lighting device(s) without completely turning the lighting device(s) off, which may be desirable in a variety of contemplated applications. For example, dimmers may be desirable in cold/frozen food sections and or aisles of grocery or other stores when there is little to no consumer traffic. In this way, the lighting devices may be dimmed down to save energy, but are not completely turned off so as to make unlit aisles/displays/shelves unappealing to consumers. However, it is understood that the lighting devices may be completely turned off when there is no consumer traffic if desired. The dimmer(s) 130 may also be coupled with a sensor(s) 152 such as an infrared (IR) sensor, which can detect consumer traffic and send a signal to the dimmer(s) 130. Other types of sensors are also contemplated in practicing the present invention. The dimmers(s) 130 can then act to turn up the intensity of the lighting devices. In some embodiments, the dimmer(s) 130 and coupled sensors 152 can light up portions of an aisle like a runway, such that the intensity of the light illuminating an aisle or display gradually increases as a consumer makes his/her way down the aisle or display. Alternatively, once a sensor 152 detects movement, it can signal the dimmer to intensify the light illuminated by all lighting devices connected to the dimmer coupled with that sensor.

In FIGS. 21-24, dimmer 130 is shown with an input cable 132, output cable 134, power input socket 136, power output box 138, mounting portion 140, and splitter input 142. Power is supplied into the dimmer 130 via input cable and socket 132, 136. Power is then sent from the dimmer 130 to lighting device(s) 10 via output cable and box 134, 138, with the amount of power depending on whether the dimmer is telling lighting devices to dim, turn off, remain at their current intensity, or if the intensity is to be increased. When a sensor 152 is coupled to the dimmer 130, a splitter may be used such that the IR sensor 152, dimmer 130, and lighting devices may all be connected to communicate with one another. In addition, a splitter may be provided so that one sensor 152 may drive multiple dimmers. Splitter input 142 is provided for receiving signal from a splitter, such as a Cat 5 Y-Splitter, which is in turn receiving signal from a sensor 152 (see FIG. 25). Alternatively, the sensor 152 may be directly connected to the dimmer 130 via input 142. Either way, the dimmer 130 can then receive a signal from the sensor 152, which it will use to communicate a desired action to the lighting device(s).

The dimmer 130 may also comprise a mounting protrusion 140 with a hole for accepting a screw, nail, post, or the like for mounting the dimmer on an external surface. Alternatively, the dimmer 130 may be mounted using double-sided tape, adhesive, or other bonding means well known in the art.

Figure 25:
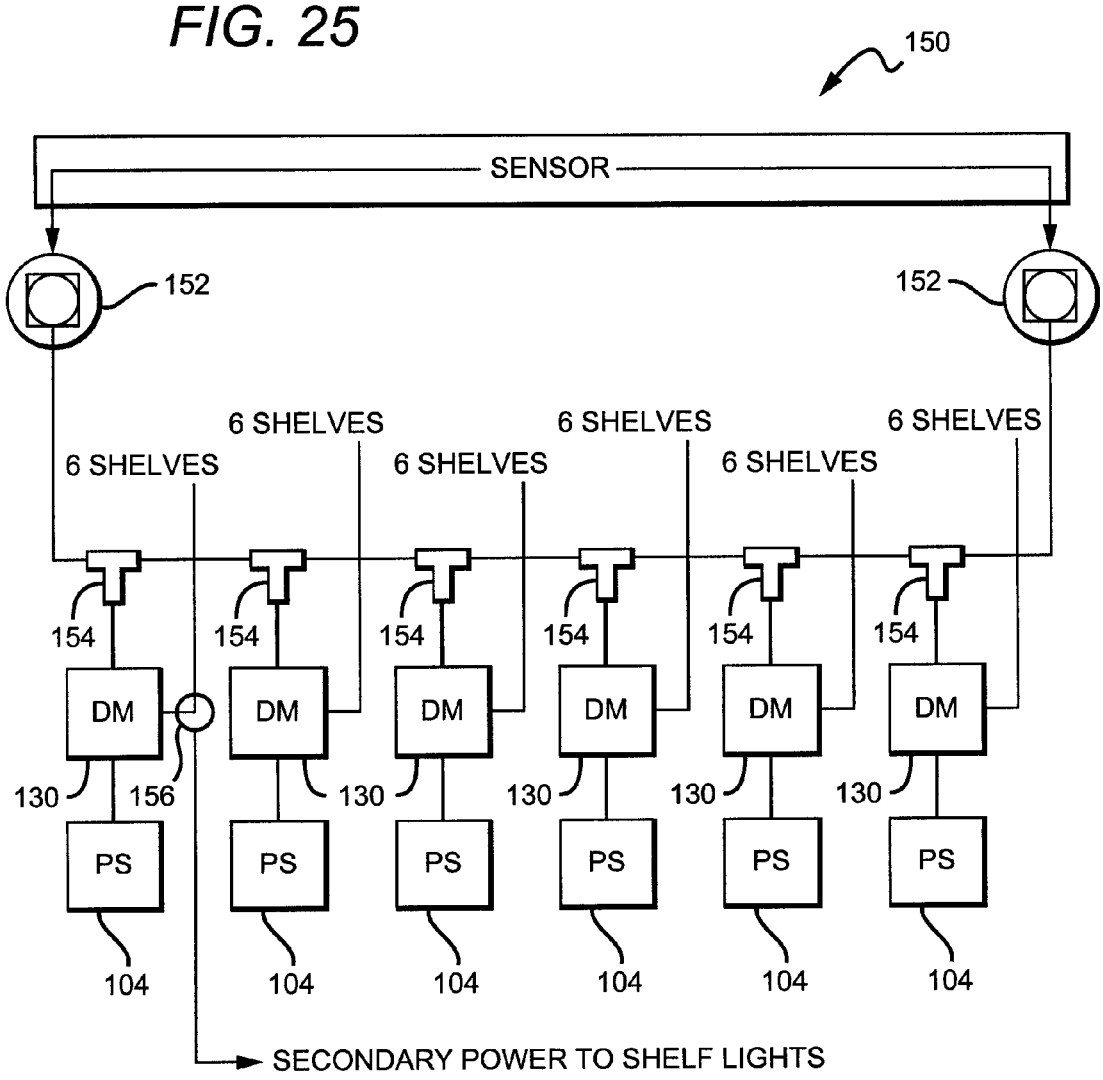
FIG. 25 is a schematic view of dimmer devices with integrated sensors connected to lighting devices, shelves, and power supplies according to the present invention.

FIG. 25 shows a schematic 150 for an embodiment using IR sensors coupled with dimmers according to the present invention. As shown, the dimmers 130 are each connected to a power supply 104, a gondola of six shelves with incorporated lighting devices, and a splitter 154. The dimmers 130 act as secondary power supplies 156 to the shelf lights. Two sensors 152 are provided, which communicate with each of the splitters 154, which in turn communicate with each of the dimmers 130. When the dimmers receive a signal from sensors 152, they in turn act to increase, maintain, and/or reduce the power sent to the lighting devices so as to dim them, turn them off, increase their light emission, or maintain their emission.

While FIG. 25 depicts two IR sensors, six gondolas of six shelves each, six dimmers, six splitters, and six power supplies, it is understood that any number, configuration, and/or combination of gondolas, sensors, dimmers, splitters, and power supplies are contemplated in practicing the present invention.

Although the present invention has been described in considerable detail with reference to certain preferred configurations thereof, other versions are possible. Accordingly, the spirit and scope of the invention should not be limited to the preferred versions of the invention described above.

We claim:

1. A lighting device comprising:

an elongated extrusion comprising a first surface and a second surface proximate said first surface, wherein said second surface is substantially reflective; and one or more light emitting devices mounted at said first surface of said extrusion;

wherein said first surface is angled with respect to said second surface such that at least a portion of said light emitted from said one or more light emitting devices reflects off said second surface;

wherein the angle of said second surface with respect to said first surface is customizable to either focus or broaden the spectrum of the light emitted from said light emitting devices.

2. The lighting device of claim 1, further comprising an overhang portion proximate said first surface for further focusing or broadening the light emitted from said light emitting devices, with said overhang portion being substantially reflective.

3. The lighting device of claim 1, wherein said second surface further comprises a substantially reflective surface.

4. The lighting device of claim 1, wherein said extrusion is comprised of one or more of aluminum, plastic, or acrylic.

5. The lighting device of claim 1, further comprising a reflector integrated with said second surface.

6. The lighting device of claim 5, wherein said reflector comprises one or more of polished aluminum, bright dip anodized aluminum, reflective tape, or a plastic insert with a reflective surface.

7. The lighting device of claim 1, further comprising a third surface between said first and second surfaces.

8. The lighting device of claim 7, wherein said third surface comprise one or more of a lens or protective cover.

9. The lighting device of claim 7, wherein said third surface accomplishes one or more of further focusing, broadening, or diffusing the light emitted from said light emitting devices.

10. The lighting device of claim 1, further comprising one or more end caps for sealing the ends of said lighting device, wherein said end caps comprise a hole or socket for receiving power for said light emitting devices.

11. The lighting device of claim 10, wherein said end caps further comprise a mounting means for mounting said lighting device and securing it in low profile with respect to a mounting surface.

12. The lighting device of claim 10, wherein said end caps further comprise an adjust mechanism for adjusting the angle of the lighting device.

13. The lighting device of claim 1, wherein said light emitting devices comprise LEDs mounted on a printed circuit board.

14. The lighting device of claim 1, further comprising power transfer devices for connecting and providing power to two or more lighting devices arranged in one or more of a vertical or horizontal configuration.

15. The lighting device of claim 1, further comprising a dimmer for changing or maintaining the intensity of the light emitted from said light emitting devices.

16. The lighting device of claim 15, further comprising a motion sensor coupled with said dimmer such that said dimmer changes or maintains the intensity of the light emitted from said light emitting devices according to a signal sent from said sensor.

17. A lighting device comprising:

an elongated extrusion comprising a first surface and a second surface proximate said first surface;

one or more light emitting devices mounted at said first surface of said extrusion; and a lens between said first and second surface, said lens protecting said one or more light emitting devices;

wherein said first surface is angled with respect to said second surface such that at least a portion of said light emitted from said one or more light emitting devices reaches said second surface;

wherein the angle of said second surface with respect to said first surface is customizable to either focus or broaden the distribution of the light emitted from said light emitting devices.

18. The lighting device of claim 17, further comprising an overhang portion proximate said first surface for further focusing or broadening the light emitted from said light emitting devices, with said overhang portion being substantially reflective.

19. The lighting device of claim 17, wherein said second surface is substantially reflective.

20. The lighting device of claim 17, wherein said light emitting devices comprise LEDs mounted on a printed circuit board.

21. The lighting device of claim 17, further comprising a reflector integrated with said second surface, wherein said reflector comprises one or more of polished aluminum, bright dip anodized aluminum, reflective tape, or a plastic insert with a reflective surface.

22. The lighting device of claim 17, further comprising one or more end caps for sealing the ends of said lighting device, wherein said end caps comprise:

a hole or socket for receiving power for said light emitting devices; and a mounting means for mounting said lighting device and securing it in low profile with respect to a mounting surface.

23. The lighting device of claim 22, wherein said end caps further comprise an adjust mechanism for adjusting the angle of the lighting device.

24. The lighting device of claim 17, further comprising power transfer devices for connecting and providing power to two or more lighting devices arranged in one or more of a vertical or horizontal configuration.

25. The lighting device of claim 17, further comprising a dimmer with an integrated motion sensor for changing or maintaining the intensity of the light emitted from said light emitting devices.

* * * * *